US010815034B2

(12) United States Patent
Johnson et al.

(10) Patent No.: US 10,815,034 B2
(45) Date of Patent: Oct. 27, 2020

(54) MULTI-SUBSTRATE BAG WITH GUSSETED MESH BOTTOM

(71) Applicant: Volm Companies, Inc., Antigo, WI (US)

(72) Inventors: Micah Johnson, Idaho Falls, ID (US); Robert Frei, Deerbrook, WI (US); John Schemecker, Rigby, ID (US)

(73) Assignee: Volm Companies, Inc., Antigo, WI (US)

( * ) Notice: Subject to any disclaimer, the term of this patent is extended or adjusted under 35 U.S.C. 154(b) by 36 days.

(21) Appl. No.: 15/594,160

(22) Filed: May 12, 2017

(65) Prior Publication Data

US 2018/0327143 A1 Nov. 15, 2018

(51) Int. Cl.

| | |
|---|---|
| ***B65D 30/06*** | (2006.01) |
| ***B65D 33/08*** | (2006.01) |
| ***B65D 33/25*** | (2006.01) |

(52) U.S. Cl.

CPC ..... *B65D 33/08* (2013.01); *B65D 29/04* (2013.01); *B65D 33/2508* (2013.01)

(58) Field of Classification Search

CPC ..... B65D 29/00; B65D 29/02; B65D 29/04; B65D 33/01; B65D 33/08; B65D 33/065

USPC ..... 383/7, 9, 10, 104, 117, 120, 100–103

See application file for complete search history.

(56) References Cited

U.S. PATENT DOCUMENTS

| | | | | |
|---|---|---|---|---|
| 1,906,500 | A | 5/1933 | Twitchell | |
| 3,799,914 | A * | 3/1974 | Schmit et al. | B65D 75/008 215/376 |
| 4,769,126 | A * | 9/1988 | Roen | B65D 33/001 206/554 |
| 4,904,093 | A | 2/1990 | Woods et al. | |
| 6,371,645 | B1 | 4/2002 | Rusert et al. | |
| 7,798,715 | B2 | 9/2010 | Hefner | |
| 8,550,717 | B2 | 10/2013 | Hefner | |
| 9,339,986 | B2 | 5/2016 | Frei et al. | |
| 9,371,143 | B2 | 6/2016 | Hefner et al. | |
| 9,561,882 | B2 | 2/2017 | Fox et al. | |
| 2003/0179957 | A1 | 9/2003 | Tankersley | |
| 2004/0032992 | A1 | 2/2004 | Hershku | |

(Continued)

FOREIGN PATENT DOCUMENTS

| | | | |
|---|---|---|---|
| EP | 1 371 569 | A1 | 12/2003 |
| JP | 2000085796 | A | 3/2000 |
| JP | 2004182262 | A | 7/2004 |

*Primary Examiner* — Jes F Pascua

*Assistant Examiner* — Nina K Attel

(74) *Attorney, Agent, or Firm* — Boyle Fredrickson S.C.

(57) ABSTRACT

A bottom gusseted bag includes first and second opposed walls that face one another, each of the first and second walls having an upper end and a lower end, and a gusseted bottom that connects the bottom ends of the first and second walls to one another. The gusseted bottom includes at least four panels that are formed from an open mesh material and that collectively form at least three pleats. Opposed side edges of all of the panels are thermally bonded directly to one another along first and second opposed seams extending at least the majority of the length of each of the panels. The gusseted bottom may have a side seam strength of at least about 1.lb (4.5 N). The first and second side walls are formed at least in part of material, such a film, that is thermally bondable to the mesh material.

24 Claims, 7 Drawing Sheets

(56) References Cited

U.S. PATENT DOCUMENTS

| | | | | |
|---|---|---|---|---|
| 2014/0349063 | A1* | 11/2014 | Frei | B32B 5/022 428/110 |
| 2014/0363105 | A1 | 12/2014 | Pelletier et al. | |
| 2015/0093050 | A1* | 4/2015 | Bunton | B65D 33/004 383/7 |
| 2015/0110423 | A1* | 4/2015 | Fox | B65D 29/04 383/117 |
| 2016/0229613 | A1* | 8/2016 | Morofuji | B65D 33/00 |
| 2017/0081083 | A1 | 3/2017 | Fox et al. | |

* cited by examiner

MULTI-SUBSTRATE BAG WITH GUSSETED MESH BOTTOM

BACKGROUND OF THE INVENTION

1. Field of the Invention

The present invention relates to bags for storing items and, more particularly, to a bag having a gusseted mesh bottom in which the mesh panels forming the gusset are heat sealed directly to one another. The invention additionally relates to a method for forming such bags.

2. Discussion of the Related Art

In order to prevent the premature spoilage of produce and other perishable items, bags storing such items often are formed at least in part of an open mesh material. The open mesh ventilates the items in the bag or allows them to "breathe," increasing the items' shelf life. The use of open mesh material in bags offers the additional advantage of rendering the stored items highly visible to potential purchasers. The mesh material can be pre-formed into the shape of a bag and filled and different times and/or locations using separate forming and filling equipment. Alternatively, the bags can be formed, filled with items, and sealed simultaneously.

More recently, so called "half-and-half" or other multi-substrate bags were introduced that are formed from a web that is part open mesh fabric and part film. The mesh material provides the desired ventilation. The film material can provide for improved viewability of the stored items, if it is clear, and/or can be printed with indicia providing information about the items stored in the bags and/or about the supplier. The film strips of these bags thus often are called "print bands." In addition to bearing indicia, the film strips also add dimensional stability to the bag, permitting the bag to stand more upright. This added dimensional stability enhances the bag's aesthetic appearance and permits more bags to be placed in a given area such as on a store shelf.

As demographics and cooking and eating habits change, produce consumers are increasingly demanding smaller-capacity bags, reflecting the reduced demand overall and/or an increased emphasis on freshness. Conversely, with respect to some items, such as avocados, that consumers historically bought only one or a few items at a time, consumers are increasingly demanding pre-packaged items to facilitate the selection and purchasing of those items. Both concerns counsel for relatively small, prefilled bags of packaged items.

Meanwhile, the desire for an aesthetically-pleasing presentation of packaged items continues to grow, as does the desire to reduce shelf space for prepackaged items by providing bags that are generally self-standing. Hence, bottom-gusseted, relatively small capacity (on the order of 1 lb to 5 lb bags) are in increasing demand. These bags often are referred to as "pouch style" bags. However, hurdles inhibit the provision of such bags in a multi-substrate form.

For example, it was historically thought to be impossible to form a bottom of any multi-substrate bag entirely from mesh material because historically-available mesh materials were incapable of being heat sealed to themselves with acceptable strength to withstand the rigors of filling and handling. Even if the bottom of the bag was formed by folding a strip of film material over, negating the need for a bottom seam, side seam failure is still a concern, counseling against the formation of the bottom of a bag entirely from a mesh material. Hence, in the past, it was historically thought to be necessary to provide a film strip or "seal strip" in the side seam of a bag having an all-mesh bottom portion to produce a seam of acceptable strength. The requirement for a sealing strip considerably adds to the complexity and cost of the bag manufacturing process.

In light of the foregoing, the need has arisen to provide a bottom-gusseted, multi-substrate bag that has good dimensional stability and that presents the items stored in the bag in an aesthetically-pleasing manner.

The need additionally has arisen to provide a bottom-gusseted bag having an all-mesh bottom portion and lacking the need for a sealing strip in the bottom portion of the bag.

The need additionally has arisen to provide an improved method for making a multi-substrate gusseted-bottom bag.

SUMMARY OF THE INVENTION

In accordance with a first aspect the invention, a gusseted multi-substrate bag is provided having a gusseted all-mesh bottom that is sufficiently strong to securely store produce or other items stored therein. The bag includes first and second opposed walls that face one another, each of the first and second walls having an upper end and a lower end, and a gusseted bottom that connects the bottom ends of the first and second walls to one another. The gusseted bottom includes a first panel having an upper end located at the first wall and having a lower end, a second panel having a lower end joined to the lower end of the first panel to form a first pleat and having an upper end, a third panel having an upper end located at the second wall and having a lower end, and a fourth panel having a lower end joined to the lower end of the second panel to form a second pleat and having an upper end. Opposed side edges of the first through fourth panels are thermally bonded directly to one another along first and second opposed seams extending at least the majority of the length of each of the panels.

In the case of a single-gusseted bag, the upper ends of the second and fourth panels are joined together to form a third pleat. The upper apex of the third pleat may have side edges that are thermally bonded to the first and third panels at the first and second opposed seams.

The gusseted bottom may have a side seam strength of at least about 1.75 lbs (7.8 N), of at least 1.2 lbs (6.7 N), and even of at least 1.0 lb (4.5 N).

Opposed side edges of the first and second walls are sealed to one another by first and second side seams that extend toward an upper end of the bag. These side seams may extend to the top of the bag. Alternatively, the side seams may terminate at least 1.25 cm beneath the top of the bag to form flaps at the top of the bag. The side edges of these flaps may be inclined relative to the vertical.

The open mesh material may comprise a non-woven material such as the commercially available Ultratech® material or a woven material such as the commercially-available Meltac® material.

In accordance with another aspect of the invention, a method is provided of forming a bottom-gusseted bag. The method includes providing a strip having first and second opposed portions formed from respective first and second strips of a film material and an intermediate portion formed from a mesh material, folding the strip to form first and second opposed walls and a bottom gusset. The bottom gusset has a first panel having an upper end located at the first wall and having a lower end, a second panel having a lower end joined to the lower of the first panel to form a first pleat and having an upper end, a third panel having an upper end located at the second wall and having a lower end, and a fourth panel having a lower end joined to the lower end of the second panel to form a second pleat and having an upper end. The method additionally includes thermally bonding opposed side edges of the first through fourth panels directly to one another along first and second opposed side seams extending at least the majority of the length each of the first through fourth panels.

In the case of as single-gusseted bag, the folding step comprises forming a third pleat at a juncture between the second and fourth panels, and the thermally bonding step comprises thermally bonding opposed side edges of an upper apex of the third pleat to the first and third panels.

Each side seam produced by the thermally bonding step may have a strength of at least 4.5 N.

Various other features, embodiments and alternatives of the present invention will be made apparent from the following detailed description taken together with the drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION

Figure 1:
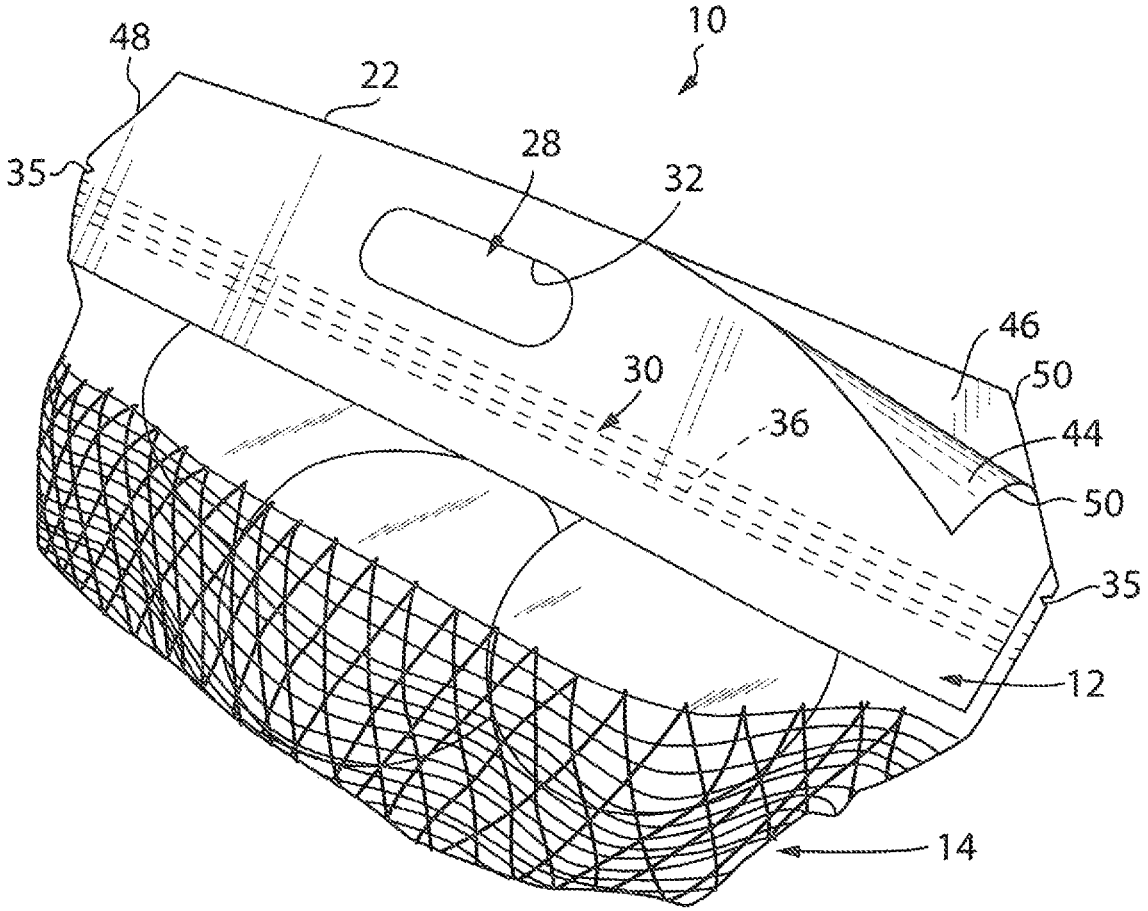
FIG. 1 is a perspective view of a multi-substrate bag produced in accordance with the present invention, showing the bag filled with items.
Figure 2:
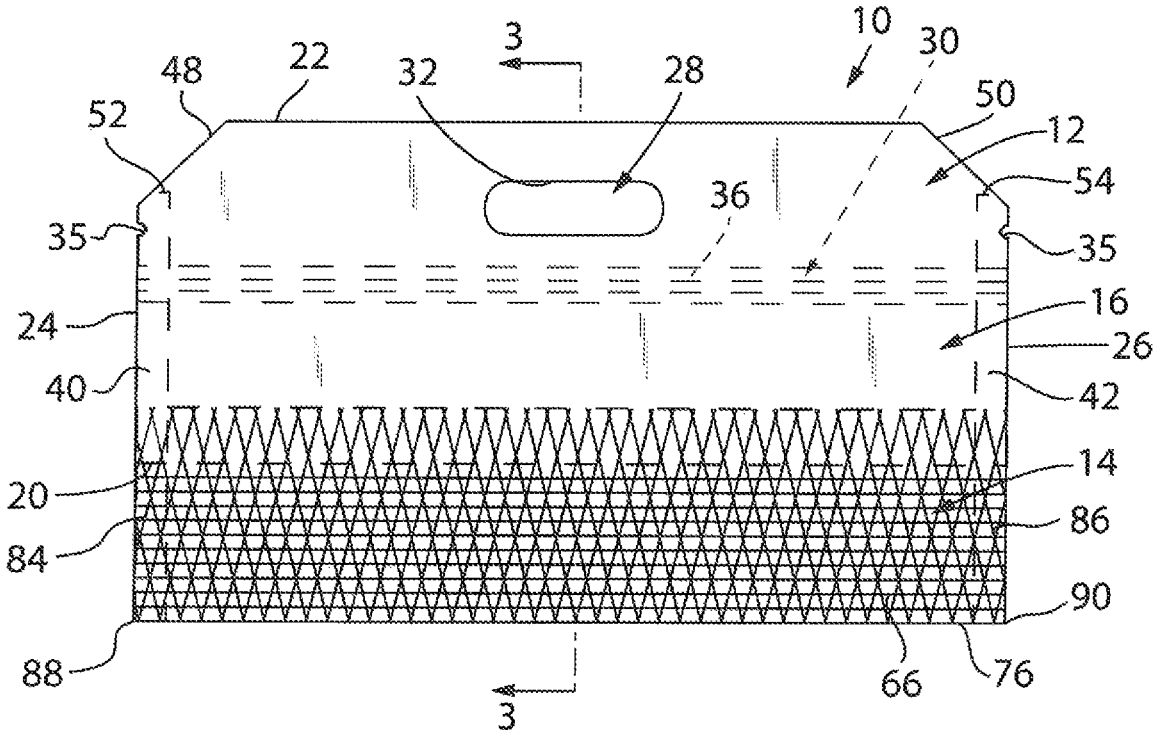
FIG. 2 is a front elevation view of the bag of FIG. 1 in a pre-filled state of the bag.
Figure 3:
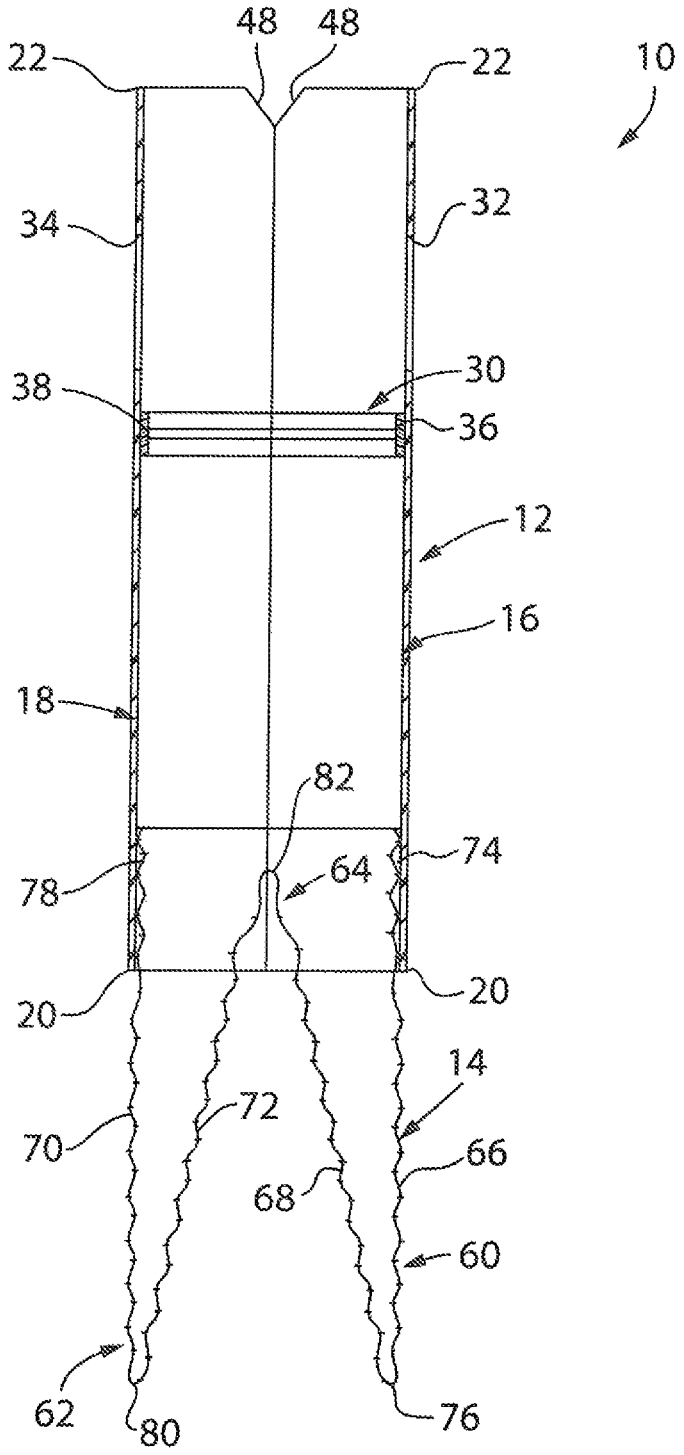
FIG. 3 is a sectional side elevation view, taken generally along the line 3-3 in FIG. 2 and showing the bag in a partially-open state.

With reference now to the drawing figures and initially to FIGS. 1-3, in which like reference numerals designate like parts throughout, a pouch style bag 10 is illustrated that is used to store items such as produce in the form of fruits or vegetables or other discrete items. The illustrated bag 10 is a so-called "multi-substrate" bag in that it is formed from strips or other portions of two or more significantly different materials joined together. If the portions are thermally bonded to one another, the respective portions should be made of materials that are thermally bondable to one another. In the illustrated embodiment, those materials include a film material forming at least a lower portion of an upper body 12 of the bag and a mesh material forming a gusseted bottom 14 of the bag 10, respectively. Alternatively, the body 12 of the bag 10 could be formed in part from another type of film material and/or from one or more mesh material strips located above the film material and/or provided as panels over or under an opening in the other materials.

It should be emphasized that these terms "body" and "bottom" are purely arbitrary. If the effective bottom of the filled bag 10 is considered to be the surface of the bag 10 that rests on a surface, such as a shelf, that supports the bag 10, the bottom of the body 12 could and usually would be located well above that surface. See FIG. 1 by way of example.

The illustrated bag 10 is a relatively small-capacity bag configured to store produce items such as avocados at a point-of-sale. The illustrated bag has a capacity of two lbs (0.9 kg), an unfilled width of 20 cm to 40 cm, and, more typically, of about 30 cm. It also has an "effective" height as that term is defined below of about 5 cm to 20 cm and, more typically, about 10 cm to 12 cm. It therefore has a width-to-height ratio of roughly 3:1. This relatively high ratio is benefitted by the gusseted bottom, but ratios of between 1:1 and 5:1 and even well beyond that range fall within the scope of the present disclosure. The stated dimensions and/or the stated ratios could vary significantly amongst bags of a given rated capacity, and the general concepts disclosed herein are applicable to bags of smaller and larger capacity, such as 1-lb (0.45 kg) bags, and 3-lb (1.4 kg) bags and even larger.

The rated capacity of a bag is generally dependent upon the interior volume of a closed bag which, in turn, is dependent on, among other things, the width of the bag, the size and number of bottom gussets, and the "effective height" of the bag as measured from the bottom apices of the gusset(s) to any closure. In the present case, such a closure is provided in the form of a zipper 30 as described below.

The interior volume of a bag can be approximated using the equation:

$$V=(w^3)(h/(piXw)-0.142(1-10^{(-h/w)}); \text{ where}$$

"w" is the width of the bag; and

"h" is the effective height of the bag.

Approximate interior volumes of various-capacity bags constructed in accordance with this disclosure are listed in Table 1:

TABLE 1

APPROXIMATE INTERNAL VOLUMES OF BAGS OF VARIOUS CAPACITIES

| BAG CAPACITY | INTERNAL VOLUME |
|---|---|
| 1 lb (0.45 kg) | 110 in.$^3$ (1800 cm$^3$) |
| 2 lb (0.9 kg) | 160 in.$^3$ (2620 cm$^3$) |
| 3 lb (1.4 kg) | 210 in.$^3$ (3440 cm$^3$) |
| 4 lb (1.8 kg) | 260 in.$^3$ (4260 cm$^3$) |
| 5 lb (2.3 kg) | 310 in.$^3$ (5080 cm$^3$) |

Referring to FIGS. 1-3, the body 12 of the bag 10 has front and rear walls 16 and 18. Each wall 16, 18 has a bottom 20, a top 22, and first and second (left and right) side edges 24, 26. (It should be noted that terms such as "top", "bottom", "front", "rear", etc. are used as a frame of reference observed by a typical purchaser of the particular bag in question but in no way requires any particular orientation of the bag or its components.) Referring to FIGS. 1-3, the illustrated bag 10 has a handle 28 and a closure 30 located beneath the handle. The handle 28 of the illustrated embodiment takes the form of aligned openings 32 and 34 formed through the upper portion of the front and rear walls 16 and 18, respectively. The closure 30 comprises a zipper or zip-lock disposed beneath openings 32 and 34. First and second (male and female) portions 36 and 38 of the zipper 30 are thermally bonded to the interior surfaces of the front and rear walls 16 and 18 in alignment with one another. Other types of handles and/or other types of closures could be provided, or handles and/or closures could be eliminated altogether in certain embodiments of bags falling within the scope of the present disclosure.

The front and rear walls 16 and 18 present front and rear surfaces of the bag 10 that, in the present embodiment, are mirror images of each other. At least the bottom portion of each wall 16 and 18 is formed from a material that is capable of being thermally bonded to the mesh material of the gusseted bottom 14 as described below. That material is a synthetic resin film material in illustrated embodiment. One such material is a so-called PET laminate having a thin layer of a relatively high melting point polyester material, serving as a print surface, laminated onto a relatively thick layer of a relatively low melding point linear low density polyethylene (LLDPE) material. The LLDPE material melts during the heat bonding process to seal the film material to adjacent materials. One or both walls 16 and 18 could be transparent. Alternatively, one or even both of these walls 16 and 18 could be formed from an opaque, translucent, or even light-blocking material. One or both of the front and rear surfaces also may have indicia printed thereon. Alternatively, paper or another film material could be laminated onto the outer surface of the film material, in which case the film material would form the inner surface of each of the walls 16 and 18 and would serve as a bonding substrate for thermal bonding to the mesh material.

Referring now to FIGS. 2 and 3, it can be seen that each of the front and rear walls 16 and 18 of this particular embodiment is formed from a continuous strip of the film material, extending from the bottom 20 of the wall to the top end 22. Both strips and thus both walls 16 and 18 of this embodiment are of identical dimensions. That is not necessarily the case, however. For example, one of the walls 16 or 18 could extend above the other and bear one or more wicket holes for hanging the bag or stacks of bags from wicket pins in preparation for filling the bag and/or at the point of sale.

The film strips of the front and rear walls 16 and 18 of the bag 10 should extend sufficiently far above the center of the zipper 30 to provide sufficient space for receiving the handgrip openings 32 and 34 in an ergonomically-acceptable manner. Heights of 1 in. to 4 in. (2.5 cm to 12.0 cm), and more typically of about 2 in. (5.1 cm), are most common. Notches or tear areas 35 may be provided above the zipper 30 to permit the top of the bag 10 to be torn off either after it is filled or by the end consumer.

Still referring to FIGS. 1-3, the front and rear walls 16 and 18 are joined to one another along left and right vertically-extending side seams 40, 42 formed by thermally bonding the walls 16 and 18 together at their opposed left and right edges 24 and 26. The width of these side seams 40, 42 may be typical of those produced by commercially-available converting equipment. Each side seam 40, 42 may have a width of, for example, 0.5 cm to 2 cm or more, and more typically of about 1 cm. The opposed edges of the film strips forming the opposed walls 16 and 18 could be bonded directly to each other as shown. In the present embodiment, the left and right side seams 40, 42 extend from below the bottom of the body 12 as discussed in more detail below in connection with the gusseted bottom 14 and upwardly along a majority, but not all, of the height of the front and rear walls 16 and 18.

Still referring to FIGS. 1-3, because the side seams 40 and 42 do not extend to the top 22 of the bag 10, the uppermost portion of the bag 10 thus has free ends forming flaps 44 and 46 (FIG. 1). These flaps 44 and 46 may be folded out to facilitate filling of the bag 10 and access to its contents, as seen in FIG. 1. In the illustrated embodiment, the left and right side edges 48 and 50 of each of these flaps 44 and 46 do not extend vertically. They instead are inclined at an acute angle relative to the vertical from beneath the upper ends 52 and 54 of the side seams 40 and 42 to the top 22 of the walls 16 and 18. The height of these flaps 44 and 46 and the inclination of this angle are primarily matters of designer preference. In the illustrated embodiment, the flaps 44 and 46 are about 2 cm high and the side edges 48 and 50 are each inclined at an angle of 50° relative to the vertical. Alternatively, the side seams 40 and 42 could extend to the top of the bag, either along an incline or vertically.

Referring particularly to FIGS. 2 and 3, the bottom 14 of the bag 10 is gusseted to permit expansion of the bag 10 when it is filled with materials and, thus, to increase the volumetric capacity of a bag 10 of a given height and width. (Compare FIG. 3, which shows the bag 10 in a mostly-closed or unfilled state, to FIG. 1, which shows a filled bag). Referring to FIG. 3, the bottom gusset is a so-called "single-gusset" in the present embodiment, having first, second, and third pleats 60, 62, and 64 and four panels 66, 68, 70, 72. It is conceivable that more gussets and, thus, more panels could be provided in some implementations. The first panel 66 has upper and lower ends. The upper end is heat sealed to the interior surface of the bottom end portion of the first wall 16 via a first horizontally-extending seam 74. The second panel 68 has a bottom end joined to the bottom end of the first panel 66 to form the first pleat 60, including a first bottom apex 76. The third panel 70 has an upper end bonded to the bottom end portion of the interior surface of the second wall 18 at a second horizontally-extending seam 78 and has a lower end. The fourth panel 72 has a lower end joined to the lower end of the third panel 70 to form the second pleat 62, including a second bottom apex 80. In this embodiment in which only a single gusset is provided, the upper ends of the second and fourth panels 68 and 72 are joined to one another to form the third pleat 64, including an upper apex 82.

The height of the panels 66, 68, 70, and 72, as defined as the distance from bottoms 20 of the walls 16 and 18 to the bottom apices 76, 80, can vary in proportion to the height of the body 12 with a variety of factors, including the number of panels and pleats provided, the desired expansion of the bag upon being filled, etc. In the illustrated example of a single-gusseted bottom, the proportion of the panel height to body height may be in the neighborhood of 1:5 to 5:1 and, more typically, about 1:2 to 2:1. In the particular embodiment illustrated, in which the body 12 of the bag 10 is about 6.5 cm high and about 31 cm wide, each panel 66, 68, 70, 72 may extend between 2.5 cm and 12 cm, and more typically between 5 cm and 10 cm, and most typically about 7 cm below the bottom of the body 12 of the bag when the bag 10 is laying in its unfilled (flat) state.

Referring now to FIGS. 2 and 3, a first or left side edge of each of the first through fourth panels 66, 68, 70, and 72 is thermally bonded to the corresponding edge of the other three panels by a side seam 84 extending vertically from the bottom apices 76 and 80 of the pleats 60 and 62 and into the first and second horizontally-extending seams 74 and 78. The upper ends of the panels 66, 68, 70, and 72 extend above the bottoms 20 of the walls 16 and 18, and thus also are bonded to the film material of the front and rear walls 16 and 18. A second, identical seam 86 is formed at the right edge of the bottom portion 14 of the bag 10. Seam 86 extends from the apices 76 and 80 of pleats 60 and 62 and into the seams 74 and 78. These seams 84 and 86 also should extend to and beyond the apex 82 of the third pleat 64 in order to add seam strength. The apex 82 of the third pleat 64 of this particular embodiment is located about 1.3 cm above the bottom ends 20 of the front and rear walls 16 and 18. Each side seam 84 and 86 may be on the order of 1 cm to 5 cm and, more typically, on the order of 1.5 cm to 3 cm wide and, most typically, on the order of about 2.6 cm wide. The side seams 84 and 86 can simply be an extension of the side seams 40 and 42 sealing the opposed side edges of the front and rear walls 16 and 18 together, and may be formed at the same time as seams 40 and 42.

Still referring to FIG. 2, the opposed bottom corners 88 and 90 of the bag form generally right angles, increasing the storage capacity of a bag of given general dimensions. This is in contrast to typical pouch style bags in which the bottom portions of the side edges of the bag and their included seals are inclined downwardly and inwardly toward the center of the bag. Alternatively, the edges bearing the seams 84 and 86 could be inclined or otherwise "shaped" (i.e., extend curvilinearly or otherwise extend other than purely vertically) along at least portions thereof.

Figure 4:
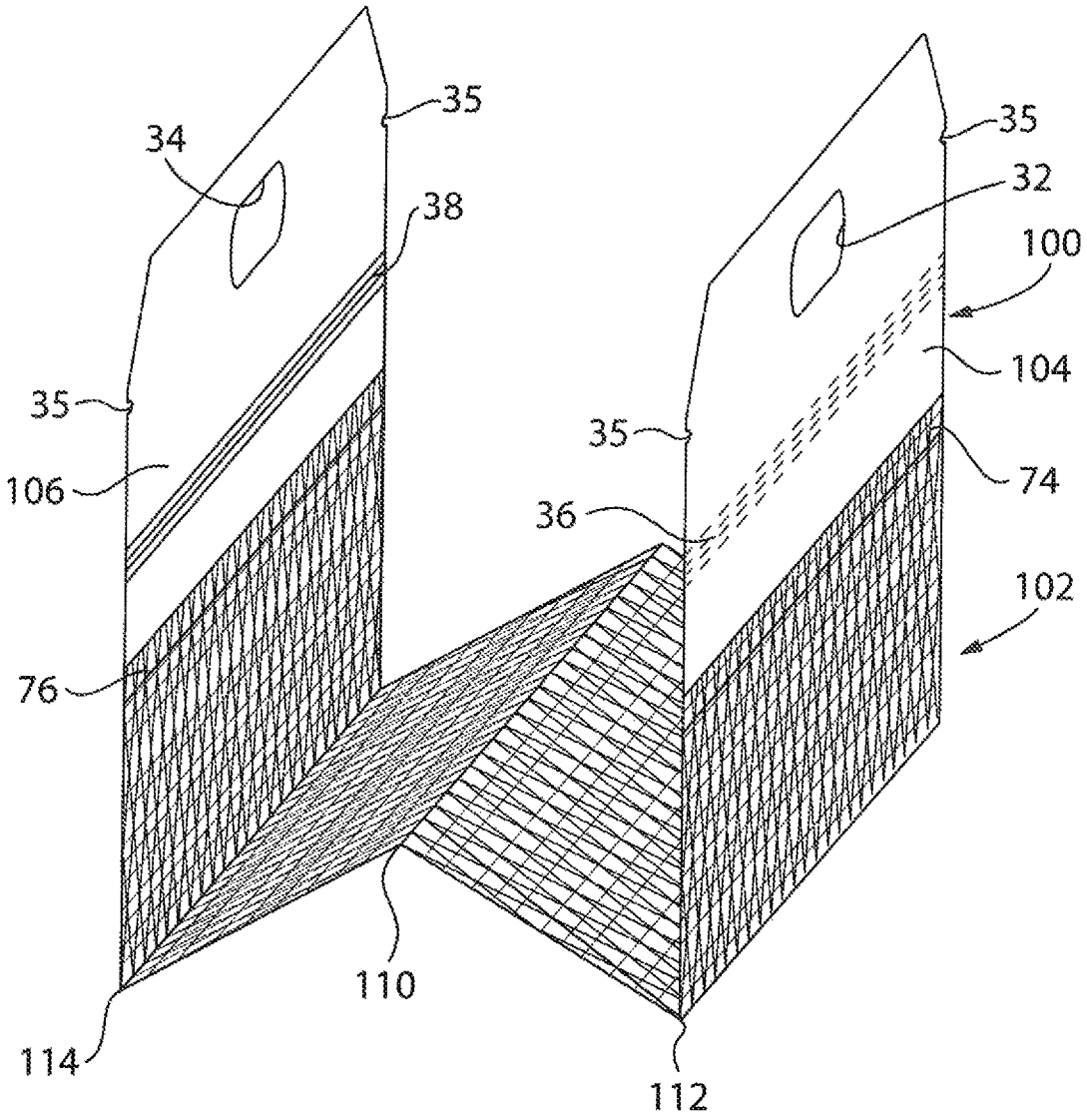
FIG. 4 is an isometric view of a web of material from which the bag of FIGS. 1-3 may be produced.

A web 100 of a multi-substrate material that can be used to form the bag 10 is shown in FIG. 4. The web 100 could be provided in the form of "roll-stock" formed from many such webs connected side-to-side or end-to-end. Web 100 includes a central mesh portion 102 having opposed ends that are thermally bonded to first and second film strips 104 and 106 by the seams 74 and 78. Mating portions 36 and 38 of the zipper 30, the mating apertures 32 and 34 in the first and second film strips 104 and 106, and the tear notches 35 also may be formed on the web 100 prior to its conversion in the bag converting machine(s). Some or all of these features alternatively could be applied to the web 100 during the converting process. The resulting web 100 of this particular embodiment is about 50 cm long×31 cm wide. The mesh strip 102 is 30 cm long, with its opposed first and second ends overlapping the respective film strips 104 and 106 by about 1.9 cm over the bottom ends in the region of the seams 74 and 78. The web 100 is folded at lines 110, 112, and 114 during the conversion process, with the center line 110 ultimately forming the apex 82 of the third pleat 64 and the lines 112 and 114 forming the apices 76 and 80 of the first and second pleats 60 and 62.

A bag 10 as described above may be formed via any of a number of processes. For example, the side seams 40, 42, 84, 86 may be formed by a machine that folds the web 100 over onto itself and that presses the strips between heated platens or heated bars for a designated dwell time and at a designated temperature as rollstock formed from the webs is conveyed through the machine. Regardless of the equipment employed, the mating layers of material at each edge of the folded web 100 are compressed between heated elements and heated to a temperature above the melting point of the bonding material of the composite filaments described below, but below the melting point of the carrier material of those composite filaments, and retained in that state for a sufficient dwell time to achieve the desired melting of the bonding material and the bonding of the layers to one another. The optimum pressure, dwell times, and temperatures will depend on each other and on the characteristics of the materials being bonded and other factors known in the art. The gusset may be formed prior to or simultaneously with the bonding process by, e.g., a pusher or a tucker that pushes the center of the mesh portion 102 forming the bottom of the bag upwardly between the first and second film portions 104 and 106 to the position shown in FIG. 3.

The converting machine could have on-board cutters that cut adjacent bags along the side seams to deliver discrete bags. Alternatively, the converting machine could deliver a continuous strip of bags connected to one another side-to-side and could wind that continuous strip onto a roll. The strip could then be withdrawn from the roll and cut into discrete bags either by a bagger's equipment or by a separate machine located at the bag manufacturing facility. Several commercially-available machines are available that could be modified without excessive effort to perform this converting process. One manufacturer of such machines is Hudson-Sharp Machine Company of Green Bay, Wis.

Figure 5:
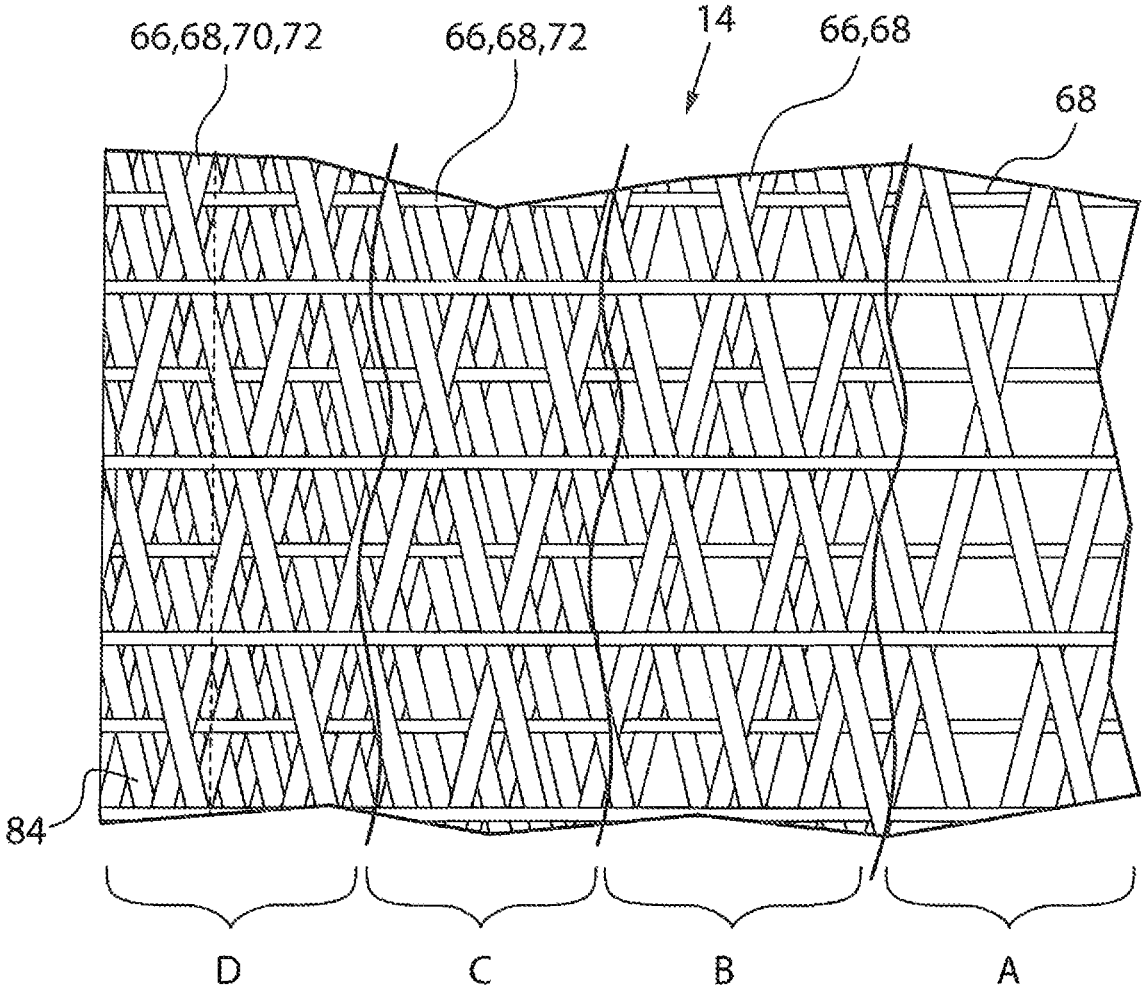
FIG. 5 is a partially cutaway front elevation view of a portion of the bag of FIGS. 1-3.

It should be apparent from the foregoing description that the entire length of the side seams 84 and 86, from the bottom 20 of the walls 16 and 18 to the bottom apices 76 and 80, is formed by thermally bonding the four panels 66, 68, 70, and 72 together without the use of any adhesives and without providing any film sealing strips between the panels or on the outside of any of the panels. Heretofore, it was thought that sealing strips were required to thermally bond the seams of all mesh bag portions together. It has been discovered however, that because four or more panels are being bonded together, as opposed to just two, a higher number of seal locations is formed by intersecting filaments or other discrete mesh portions along the side seams. This effect is illustrated in FIG. 5, which shows an edge portion of the gusseted bottom 14 of the bag 10, with the four panels 66, 68, 70, and 72 forming the gusset being peeled away as one proceeds from left to right along the drawing. Hence, portion "A" contains only the panel 66, portion "B" contains the panels 66 and 68, portion "C" contains the panels 66, 68, and 72, and portion "D" contains all four panels 66, 68, 70, and 72. If one were to think of the situation as progressively stacking the panels to form a four-panel stack at the left-most portion of FIG. 5, it can be seen that there are few if any locations in the area of the seam 84 in which openings extend completely through the stacked panels 66, 68, 72, 70, and most locations have three or more vertically-aligned mesh portions that are available for thermal bonding to one another.

Perhaps counterintuitively, it is also helpful, but not essential, to provide an open mesh material that is relatively "open" to the extent that it is formed by crossing filaments rather than from a perforated or slit-and-stretched sheet. The open areas between the filaments provide more opportunities for the bonding portions of the mesh material that melt during the thermal bonding process to flow between the stacked layers, more securely bonding those layers together.

It has also been found that seam strength can be enhanced by providing an open mesh material whose opposed front and rear surfaces can be thermally bonded at least generally equally effectively to themselves as to each other. This characteristic is beneficial, though not essential, because the panels extend in opposite directions (up or down) in a zig-zag fashion such that, for example, the front of the second panel 68 faces and directly contacts the front of the fourth panel 72, and the rear of the first panel 66 faces and directly contacts the rear of the second panel 68.

It is also believed that seam strength can be improved through the provision of an open mesh material with "flat" filaments, i.e. filaments that are ovoid or rectangular in transverse cross section. Such filaments stack well in that two intersecting strands contact each other along a relatively large area and thus are available for bonding over that relatively large contact area.

One material having all of these characteristics is an open mesh material marketed under the trademark Ultratech® by the assignee of the present disclosure. Ultratech® is an open mesh material formed from tapes or filaments, at least some of which are composite filaments. (A "filament" as used herein denotes tapes having a generally rectangular cross section, a mono-filament yarn having a circular or ovoid cross section, or multifilament tapes or yarns intertwined with one another.) Ultratech® is formed from a number of layers of individual intersecting filaments formed from a composite material having a high melting point "carrier" portion and a relatively low melting point "bonding" portion. The carrier portion may be formed, for instance, from a high-density polyethylene (HDPE). The bonding portion may be formed, for instance, from a linear low density polyethylene (LLDPE).

Figure 6:
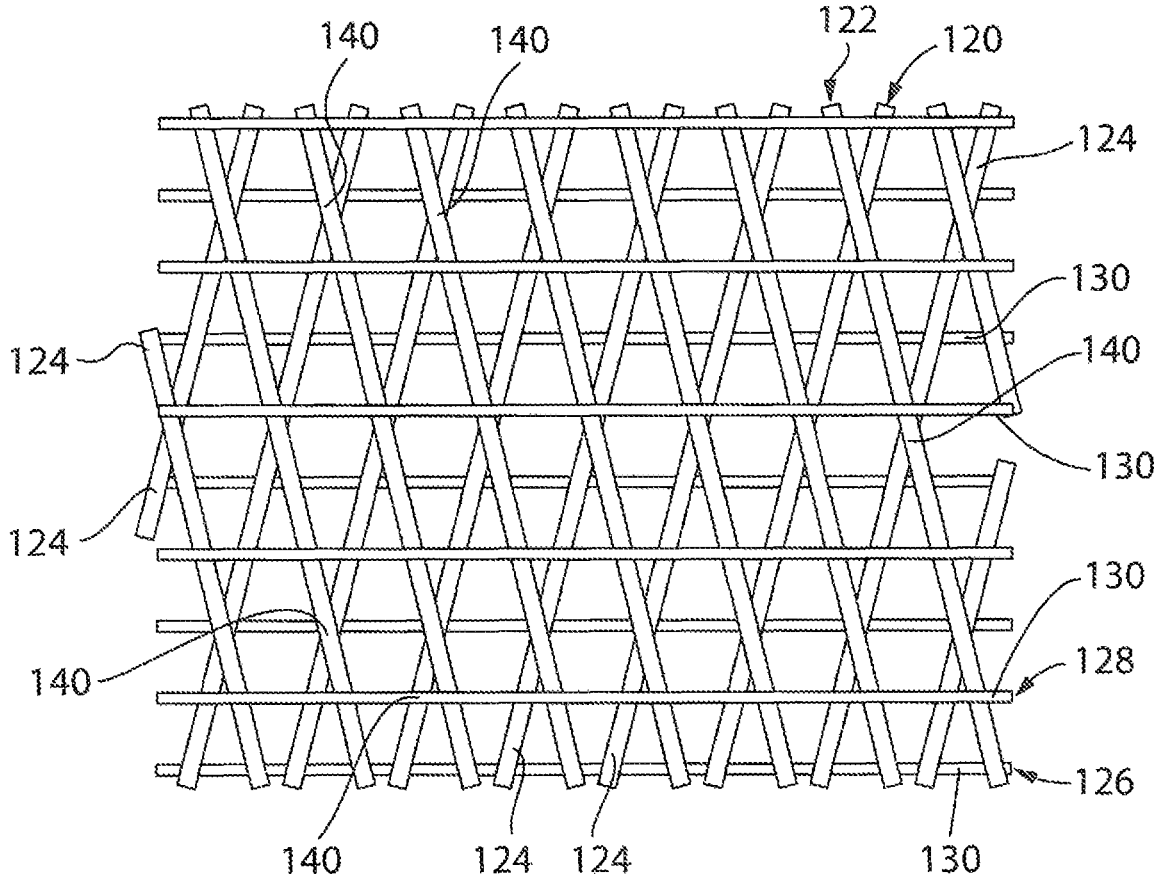
FIG. 6 is a side elevation view of a portion of a strip of open mesh material usable to make the bag of FIGS. 1-3.

Referring to FIG. 6, the Ultratech® open mesh material extends in mutually orthogonal machine and cross machine directions. The filaments are arranged in first and second layers 120 and 122 of individual weft filaments 124 that cross one another at an acute angle relative to the cross machine direction. Third and fourth layers 126 and 128 of individual warp filaments 130 extend in the machine direction and are disposed outside of the first layer 120 and the second layer 122, respectively. The filaments 130 of each of the third and fourth layers 126 and 128 extend at least generally in parallel with one another in the machine direction. The filaments of the third layer 120 may be offset relative to the filaments of the fourth layer 128, as illustrated in FIG. 6, or may be aligned with those filaments. Some or all of the filaments 124 and 130 could comprise composite filaments.

Figure 7:
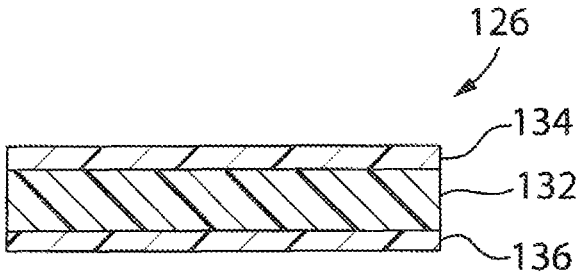
FIG. 7 is a sectional side elevation view of one of the composite filaments of the open mesh material of FIG. 6.
Figure 8:
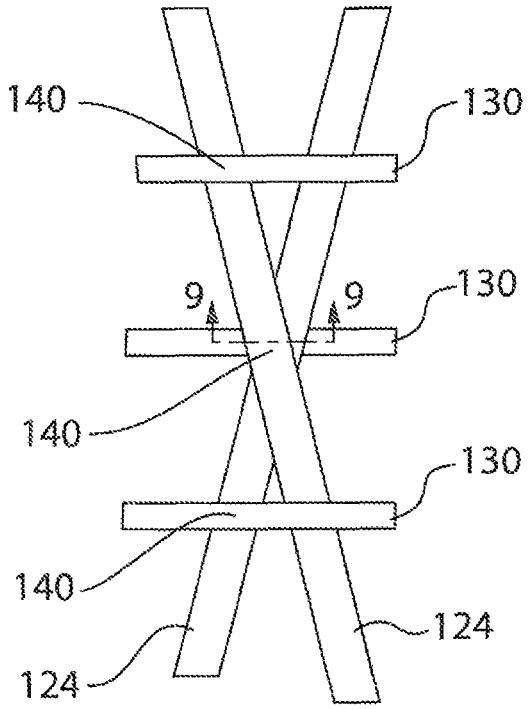
FIG. 8 is a somewhat schematic elevation view of a portion of the strip of mesh material shown in FIG. 6.

The individual composite filaments of the Ultratech® fabric illustrated herein are rectangular filaments formed from a tri-layer co-extruded material schematically illustrated in FIG. 7. That material has a center carrier layer 132 of a relatively high melting point material that is flanked by upper and lower bonding layers 134 and 136 of a relatively low melting point material. The layers 132, 134, and 136 may be formed from any combination of materials described above so long as the carrier layer is formed of a higher melting point material than that of the bonding layers. The proportions of the two materials forming the carrier layer and the bonding layers, respectively, can vary significantly depending on factors including the properties of the materials that are utilized and the desired properties of the fabric. The composite filaments may, for example, have a thickness of 10 μm to 200 μm and more typically 30 μm to 150 μm, with the carrier layer 132 comprising from 25% to 95% of the composite filament by volume.

Figure 9:
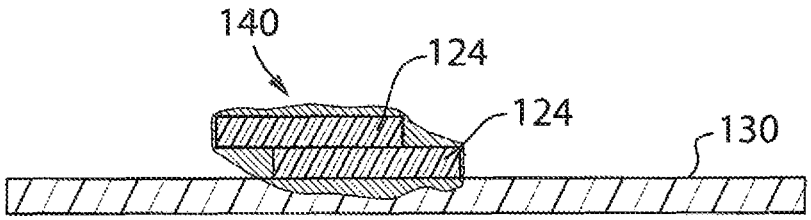
FIG. 9 is a sectional elevation view taken generally along the line 9-9 in FIG. 8.

If some or all filaments of both the warp layers 126 and 128 and the weft layers 120 and 122 are composite filaments, the weft filaments 124 are positively bonded to both the warp filaments 130 and to each other over relatively large contact areas at their points of intersection 140 as schematically illustrated in FIG. 9, resulting in a higher material strength in the cross machine direction than is present in a material in which the weft filaments are not made from a composite material (assuming that all other characteristics of the fabric, including filament thickness, filament density, filament composition, etc., are the same).

The resulting open mesh fabric is dimensionally stable, offers very low residual shrinkage and extension, and can be thermally bonded together with materials with similar melt index properties such as the same or similar fabrics, films, etc. It also has a high strength to weight ratio. It can have a mass of less than 30 $g/m^2$ and a strength to mass ratio in at least one of the machine and cross machine directions of at least 2.67 $N/(g/m^2)$, where strength is measured in accordance with ASTM standard D 5034. It also has a burst strength of at least 80 kPa, where burst strength is measured in accordance with ASTM standard D 3786. It also has a tear strength at the points of filament intersection of over 10 N, where tear strength is stated in terms of material breaking force.

A more detailed discussion of the material that is being marketed under the Ultratech® name and variations of that material can be found in U.S. Pat. No. 8,186,475, the contents of which are incorporated herein by reference in their entirety.

Other open mesh materials also conceivably could be used in the gusseted bottoms of at least some bags constructed in accordance with the present disclosure.

One such material is commercially available from Hagihara Industries under the brand name Meltac®. Meltac® is a woven fabric formed from tri-layer composite rectangular filaments that are interwoven in a rectilinear grid-like pattern. According to data sheets describing it, Meltac® has a tensile strength of 130 N/cm in the warp direction and 100 N/cm in the weft direction. It has a "welding temp" or thermal bonding temperature of 115 deg. C. to 125 deg. C. A given surface of Meltac®, like Ultratech®, can thermally bond to itself and to the opposite surface with generally equal effectiveness. Meltac® also is relatively open, though not as open as Ultratech®.

Yet another possible open mesh material that could be used to produce the gusseted bottoms of bags constructed in accordance with the present disclosure is commercially available from JX-NIPPON-CLAF under the brand name CLAF®. CLAF® is a cross laminated polyolefin open mesh nonwoven material formed from two layers of cross-laminated fibrillated composite films. Each strand is highly oriented and heat sealable. According to available data sheets, CLAF® has a tensile strength of 100-300N/50 mm. CLAF® is less open than either Ultratech® or Meltac®. In addition, unlike Ultratech® and Meltac®, a given CLAF® surface cannot thermally bond to itself and to the opposite surface with generally equal effectiveness. These limitations likely restrict the range of applications with which CLAF® is acceptable. Even within that restricted range, the limitations likely require reduced production rates when compared to the production rates of bags made from Ultratech® or Meltac® because longer dwell times would be required to produce seams of even minimally acceptable strength.

The above-described 2-lb bag has been successfully produced using Ultratech® as the mesh material of the bottom gusset. The specific grade of Ultratech® material used was a so-called "90, 70 tri-layer material". More specifically, the warp filaments had a center carrier layer having a thickness of 72 μm flanked by two bonding layers, each having a thickness of 9 μm. The weft filaments, on the other hand, had a center carrier layer thickness of 56 μm and first and second opposed bonding layers each having a thickness of 7 μm. Other grades with higher or lower percentages of bonding materials could be beneficial, for example, in applications relating to higher-capacity bags.

The side seams of twenty samples of simulated bottom gussets were tested using the following procedure:

1. Cut the fabric into 1 in. long×6 in. wide (2.54 cm×15.25 cm) sample strips with the side seal in the center of the measured sample.
2. Load a sample into testing equipment having upper and lower jaws, centering the side seal between the upper and lower jaws.
3. Move the upper jaw vertically away from the bottom jaw at a constant rate of 12 in./minute (30.5 cm/minute).
4. Record maximum seal breaking strength.
5. Return the upper jaw to the initial preset location.

The testing revealed that the left side seams of the tested samples exhibited an average strength of 4.3 lbs (19.1 N), with a standard deviation of 1.3 or 30% and that the right side seals exhibited an average strength of 5.5 lbs (23.6 N) and a standard deviation of 1.3 or 24%. The sample-to-sample variability is believed to be due to differences in the manner in which the filaments of the four panels overlap in a given sample and due to variations in the production process such as temperature, pressure, and dwell times for seam formation. The side-to-side variability is believed to be due to differences in sealing equipment used to form the seams on the opposite sides of the bag.

The tested seam strengths are more than adequate for a 2-lb produce bag. In fact, a side seam strength of at least about 1.75 lbs (7.8 N), of at least 1.5 lbs (6.7 N), and even of at least 1.0 lb (4.5 N) would be acceptable in at least some applications.

It should be noted that acceptable minimum side seam strengths vary from application to application. For instance, acceptable side seam strengths are considerably smaller for lower capacity bags and higher for higher capacity bags due to the variations and the stresses imposed on the seams during filling and handling. Many changes and modifications could be made to the substrates, web, bags, and production systems and processes disclosed herein without departing from the spirit of the present invention. To the extent that they might not be apparent from the above, the scope of these variations will become apparent from the appended claims.

What is claimed is:

1. A bag comprising:

A) first and second opposed walls that face one another, each of the first and second walls having an upper end and a lower end; and B) a gusseted bottom that is formed entirely of an open mesh material and that connects the lower ends of the first and second walls to one another, the gusseted bottom including 1) a first panel having an upper end located at the first wall and having a lower end, 2) a second panel having a lower end joined to the lower end of the first panel to form a first pleat and having an upper end, 3) a third panel having an upper end located at the second wall and having a lower end, and 4) a fourth panel having a lower end joined to the lower end of the second panel to form a second pleat and having an upper end, wherein opposed side edges of the first through fourth panels are thermally bonded directly to one another along first and second opposed seams extending at least the majority of the length of each of the panels linearly to a bottommost end of the bag, wherein each of the first and second opposed seams has a strength of at least 4.5 N.

2. The bag as recited in claim 1, wherein the upper ends of the second and fourth panels are joined together to form a third pleat.

3. The bag as recited in claim 2, wherein the third pleat has an upper apex having side edges that are thermally bonded to the first and third panels at each of the first and second opposed seams.

4. The bag as recited in claim 2, wherein the first through fourth panels are all formed of a continuous strip of mesh material.

5. The bag as recited in claim 4, wherein each of the first and second opposed seams has a strength of at least 6.7 N.

6. The bag as recited in claim 4, wherein each of the first and second opposed seams has a strength of at least 7.8 N.

7. The bag as recited in claim 1, wherein the bag has a volumetric storage capacity of between about 0.5 kg and about 2.5 kg.

8. The bag as recited in claim 7, wherein the bag has a volumetric storage capacity of about 0.9 kg.

9. The bag as recited in claim 1, wherein at least a bottom portion of each of the first and second walls that is located above the respective one of the first and third panels is formed at least in part from a film material, and wherein the upper ends of the first and third panels are thermally bonded to bottom ends of the first and second walls along first and second horizontally-extending seams, respectively.

10. The bag as recited in claim 9, wherein an upper portion of each of the first and opposed second side seams extends into the first and second horizontally-extending seams.

11. The bag as recited in claim 10, wherein at least substantially all of at least an inner face of the first and second walls is formed from the film material.

12. The bag as recited in claim 1, wherein opposed side edges of the first and second walls are thermally bonded to one another at first and second side seams.

13. The bag as recited in claim 12, wherein the first and second side seams terminate at least 1.25 cm beneath the top of the bag to form flaps at the top of the bag.

14. The bag as recited in claim 13, wherein the opposed side edges of the first and second walls extend at an acute angle relative to the vertical.

15. The bag as recited in claim 1, wherein the open mesh material is a non-woven material.

16. The bag as recited in claim 1, wherein the open mesh material is woven material formed from individual filaments that are woven together, at least some of the filaments being composite filaments having a carrier portion of a relatively high melting point and a bonding portion of a relatively low melting point, the bonding portion of each composite filament being thermally bonded to other filaments at at least some points of intersection.

17. A bag comprising:

A) first and second opposed walls that face one another, each of the first and second walls having an upper end and a lower end; and B) a gusseted bottom that is formed entirely of an open mesh material and that connects the lower ends of the first and second walls to one another, the gusseted bottom including 1) a first panel having an upper end located at the first wall and having a lower end, 2) a second panel having a lower end joined to the lower end of the first panel to form a first pleat and having an upper end, 3) a third panel having an upper end located at the second wall and having a lower end, and 4) a fourth panel having a lower end joined to the lower end of the third panel to form a second pleat and having an upper end, wherein opposed side edges of the first through fourth panels are thermally bonded directly to one another along first and second opposed linear seams extending at least the majority of the length of each of the panels to a bottommost end of the bag, wherein each of the first and second opposed linear seams has a strength of at least 4.5 N, and wherein the open mesh material comprises layers of individual filaments that intersect one another, at least some of the filaments being composite filaments having a carrier portion of a relatively high melting point and a bonding portion of a relatively low melting point, the bonding portion of each composite filament being thermally bonded to other filaments at at least some points of intersection.

18. The bag as recited in claim 17, wherein the open mesh material extends in machine and cross machine directions, and wherein the open mesh material has a mass per unit area of less than 30 g/m$^2$ and a breaking elongation in at least one of the machine and cross machine directions of no more than about 50%, where breaking elongation is measured in accordance with ASTM standard D 5034.

19. The bag as recited in claim 17, wherein the open mesh material extends in mutually orthogonal machine a cross machine directions, wherein the filaments of the open mesh material include first and second layers of individual weft filaments that cross one another at an acute angle relative to the cross machine direction, wherein the filaments of the open mesh material include third and fourth layers of individual warp filaments that extend in the machine direction and that are disposed outside of the first layer and the second layer, respectively, and wherein the filaments of each of the third and fourth layers extend at least generally in parallel with one another in the machine direction.

20. A bag comprising:

(A) first and second opposed film walls, each having an upper end located at an upper end of the bag and having a lower end;

(B) a gusseted bottom that connects the first and second walls to one another, the gusseted bottom being formed entirely from a continuous strip of an open mesh material and including 1) a first panel having an upper end thermally bonded to the lower end of the first wall along a first horizontally-extending seam, 2) a second panel having a lower end joined to the lower of the first panel to form a first pleat and having an upper end, 3) a third panel having an upper end thermally bonded to the lower end of the second wall along a second horizontally-extending seam and having a lower end, and 4) a fourth panel having a lower end joined to the lower end of the second panel to form a second pleat and having an upper end disposed above the second pleat and being joined to the upper end of the second panel to form a third pleat, wherein opposed side edges of the first through fourth panels are thermally bonded directly to one another along first and second opposed linear vertically extending side seams extending the entire length of each of the panels and extending along opposed side edges of the first and second film walls to a bottommost end of the bag, and wherein each of the side seams joining the first through fourth panels has a strength of at least 4.5 N.

21. A method of forming a bag comprising, (A) providing a strip having first and second opposed portions formed from respective first and second strips of a film material and an intermediate portion formed from a mesh material;

(B) folding the strip to form first and second opposed walls and a bottom gusset, the bottom gusset being formed entirely from the mesh material and having 1) a first panel having an upper end located at the first wall and having a lower end, 2) a second panel having a lower end joined to the lower of the first panel to form a first pleat and having an upper end, 3) a third panel having an upper end located at the second wall and having a lower end, and 4) a fourth panel having a lower end joined to the lower end of the second panel to form a second pleat and having an upper end; and (C) thermally bonding opposed side edges of the first through fourth panels directly to one another along first and second opposed side seams extending at least the majority of the length each of the first through fourth panels linearly to a bottommost end of the bag, wherein each of the first and second opposed side seams has a strength of at least 4.5 N.

22. The method as recited in claim 21, wherein the folding step comprises forming a third pleat at a juncture between the second and fourth panels, and the thermally bonding step comprises thermally bonding opposed side edges of an upper apex of the third pleat to the first and third panels.

23. The method as recited in claim 21, wherein the intermediate portion of the strip is formed from a continuous strip having first and second opposed ends thermally bonded to ends of the first and second strips of film material along first and second horizontally extending seams, respectively, and wherein the first and second opposed side seams extends vertically thorough and beyond the first and second horizontal seams.

24. The method as recited in claim 21, wherein the mesh material has first and second faces on opposite sides of the strip, and wherein, during the bonding step, the first and second faces are thermally bonded to each other and to themselves with at least generally equal effectiveness.

* * * * *